US005234139A

United States Patent [19]

Korenstein

[11] Patent Number: 5,234,139

[45] Date of Patent: Aug. 10, 1993

[54] APPARATUS FOR THE MANAGEMENT OF PAIRED GARMENTS

[76] Inventor: Michael W. Korenstein, 140 Eileen Ct., Moraga, Calif. 94556

[21] Appl. No.: 906,760

[22] Filed: Jun. 30, 1992

Related U.S. Application Data

[63] Continuation-in-part of Ser. No. 740,915, Aug. 6, 1991, abandoned.

[51] Int. Cl.[5] ..... A47G 25/48

[52] U.S. Cl. ..... 223/85; 223/88; 223/93

[58] Field of Search ..... 223/85, 88, 90, 91, 223/93, DIG. 1, DIG. 2; D6/315, 326; 211/113

[56] References Cited

U.S. PATENT DOCUMENTS

| | | | |
|---|---|---|---|
| D. 82,948 | 12/1930 | Livingston | 223/93 X |
| 1,112,775 | 10/1914 | Crutcher | 223/96 X |
| 2,244,355 | 6/1941 | Britner | 223/91 |
| 2,412,735 | 12/1946 | Isaak | 223/88 |
| 2,779,076 | 1/1957 | Schneck | 24/137 |
| 2,806,641 | 9/1957 | Rowe | 223/96 |
| 2,893,614 | 7/1959 | Rowe | 223/96 |
| 2,953,828 | 9/1960 | Hochman | 24/17 |
| 3,018,026 | 1/1962 | Brinkley et al. | 223/91 |
| 3,140,386 | 9/1964 | Trundy | 24/157 |
| 3,343,734 | 9/1967 | Merriman | 223/96 |
| 3,348,275 | 10/1967 | Lawrence | 24/255 |
| 3,414,944 | 12/1968 | Rabinowitz | 24/81 |
| 3,524,230 | 8/1970 | Aukel . | |
| 3,673,639 | 7/1972 | Driscoll | 24/16 |
| 3,688,348 | 9/1972 | Klotz et al. | 24/16 |
| 3,699,617 | 10/1972 | Hotmeister | 24/81 |
| 3,729,780 | 5/1973 | White | 24/156 |
| 3,746,223 | 7/1973 | Batts | 223/91 |
| 3,774,267 | 11/1973 | Sneader | 24/81 |
| 3,972,094 | 8/1976 | Fuller | 24/150 |
| 4,045,844 | 9/1977 | Murray | 24/81 |
| 4,414,716 | 11/1983 | Stastney | 24/3 |
| 4,474,316 | 10/1984 | Philbert | 223/85 |
| 4,503,591 | 2/1985 | Adamska-Koperska | 24/161 |
| 4,536,924 | 8/1985 | Willoughby | 24/487 |
| 4,579,262 | 4/1986 | Keenan | 223/85 |
| 4,655,375 | 4/1987 | Dazeotopulos | 223/85 |

*Primary Examiner*—Clifford D. Crowder
*Assistant Examiner*—Bibhu Mohanty
*Attorney, Agent, or Firm*—Limbach & Limbach

[57] ABSTRACT

Apparatus are described for the management of paired garments. The disclosed apparatus includes clamps for clamping together pairs of paired garments, i.e., socks or other textile articles, while laundering, storing or displaying the same at the point of sale. Each clamp includes a pair of elongated rectilinear members which terminate at one common end at a ringshaped resilient integral member and terminate at the opposite end in a pair of interlocking members. Further, each clamp is provided with a hook for hooking it, and the paired garments borne by it, to a clothesline, a rod or dowel having the diameter of a common plastic hanger cross-bar, a clothes pole, etc. The entire structure may be integrally molded as a single component in an injection mold.

8 Claims, 5 Drawing Sheets

APPARATUS FOR THE MANAGEMENT OF PAIRED GARMENTS

BACKGROUND OF THE INVENTION

This application is a continuation-in-part of my prior co-pending application Ser. No. 07/740,915 filed Aug. 6, 1991 now abandoned.

My present invention relates to apparatus for the management of paired garments, and more particularly to apparatus for joining together the garments of a pair so that they will remain together from doffing to donning, i.e., whenever they are not being worn, and thus will remain together during transport, storage, display, and laundering, and will not become separated except when being worn.

The term "prior art, as used herein or in any statement made by or on behalf of applicant means that any document or thing referred to as prior art bears, directly or inferentially, a date which is earlier than the effective filing date hereof.

Apparatus for the management of paired garments are known in the prior art.

One such apparatus is shown and described in U.S. Pat. No. 3,972,094, issued to Kenneth J. Fuller on Aug. 3, 1976, and entitled DEVICE FOR SECURING AND STORING PAIRED SOCKS. The apparatus of this patent includes a plurality of clips each of which is adapted for securing a matched pair of socks, particularly during laundering, and for storing them after the laundering is completed. These clips have three lips forming an integral part thereof. The apparatus of this patent includes a compartmentalized box for storing the secured socks, which box is provided with grooves adapted to engage the lips on each clip.

In U.S. Pat. No. 4,045,844, issued Sep. 6, 1977, to David T. Murray, there is shown and described a SOCK LOCK DEVICE for maintaining a number of pairs of socks together during a washing and drying operation. The device of this patent includes a number of clothespin elements detachably joined together, wherein each clothespin element is capable of maintaining one pair of socks together. A mechanism is provided for hanging the device on a clothesline for a drying operation.

In U.S. Pat. No. 3,699,617, issued to John M. Hofmeister on Oct. 24, 1972, there is shown and described a CONNECTING DEVICE FOR ARTICLES OF CLOTHING which is adapted for detachably joining together two articles of clothing for laundering, such as socks. The connecting device of this patent has two similar connecting members each of which is permanently attached to one garment of a pair. The connecting members each have a single stud, or a pair of studs at one end, which pierce one of the garments. Flanges at the opposite ends of each member lock the studs in place after the member is folded upon itself, securing the garment therebetween. Attachment plugs are formed on each connecting member and are snapped together, detachably retaining the two garments in their proper pair.

In U.S. Pat. No. 4,536,924, issued to Patrick Willoughby on Aug. 27, 1985, there is shown a ONE PIECE CLAMPING DEVICE which is intended to enable a matched pair of clothing articles to be held together during washing, drying and afterwards, thereby eliminating the need to sort and roll pairs of such clothing items as socks and hosiery after laundering. The clamping device of this patent includes a proximal flexible hinge portion, distal portions having non-penetrating substantially flat gripping surfaces, and male and female medial portions. The male medial portion has a male locking member, one surface of which is toothed and the other surface of which is non-toothed. The female medial portion has a female locking cavity and a locking ledge extending therein. The toothed surface of the male locking member thereby meshes with the locking ledges of the female cavity. The male medial portion also includes a male guide, and the female medial portion also includes a female guide channel for receiving the guide, and a spur to guide the non-toothed surface of the male locking member into position in the female cavity, and to retain it.

In U.S. Pat. No. 4,579,262, issued to Paul B. Keenan et al, on Apr. 1, 1986, there is shown and described a HANGER BAR ASSEMBLY FOR SOCKS which includes a pair of spaced, parallel, horizontal support bars which suspend, therebetween, a plastic hanger bar assembly over which a sock or socks are draped. The hanger bar assembly has a pair of downwardly opening hooks carrying, therebetween, an inclined support bar, reinforced by a web extending beneath the bar. Opposed inwardly protruding fingers above and parallel to the hanger bar hold the sock in place.

Other United States patents relating to devices for joining together the socks of a pair during a washing operation are listed hereinbelow.

It is believed that the documents listed immediately below contain information which is or might be considered to be material to the examination of this patent application.

| Patent No. | Inventor |
|---|---|
| 2,779,076 | W. Schenck, Sr. |
| 2,806,641 | Rowe |
| 3,018,026 | Binkley |
| 3,149,386 | Trundy |
| 3,414,944 | Rabinowitz |
| 3,524,230 | Hankel |
| 3,688,348 | Klotz |
| 3,348,275 | Lawerance |
| 3,729,780 | White |
| 3,746,223 | Batts |
| 3,774,267 | Sneider |

The prior art includes several differently shaped devices, and techniques, for holding paired garments together during manufacture, during bulk storage and shipping, and at the point of sale and display. However, these prior art devices and techniques do not lend themselves to use in retail stores for sales display and in the home where paired garments must be regularly used.

At the present time there are very few fabric hangers which will allow garments to be stored without folding the garment, or stretching the neck when being mounted on or removed from the hanger. When fabric is folded over a hanger it creases the fabric, and often produces a fold in the fabric which is immediately visible. When the neck of a garment is stretched it normally will not fit as well as it did when it was new, thus reducing the value of the garment.

The regular, puzzle-like game of re-mating paired garments after cleaning requires great skill at matching, based on size, shape, length, type of material and color. The problem becomes even more complex if both paired garments do not make it through each step of each phase at the same time, and in the same condition, while not hiding within or clinging to some other garment.

Careful analysis of the problem of managing paired garments discloses that the management of paired garments can be analyzed into a sequence of three phases, which sequence occurs repeatedly throughout the life of the garments of a particular pair.

These three phases may be described as follows, in sequential order:

(1) The READY-TO-WEAR phase is that phase during which paired garments are mated, cleaned, and maintained in a ready-to-wear condition and location.

(2) The BEING-WORN phase is the phase in which one garment is put on each foot or hand, and ends when both paired garments are removed from the foot or hand.

(3) The DANGER phase consists of the two sub-phases described immediately below.

The first such DANGER sub-phase occurs at the manufacturing location, immediately after the fabrication and mating of the garments of a pair for packing, shipping, and sales display purposes.

The second DANGER sub-phase occurs immediately after the BEING-WORN phase ends, and just before the BEING-WORN phase next begins. During the DANGER phase both garments must proceed through each remaining step together. In general, the remaining steps are during collection, being transported to dirty holding, washing, drying, clean holding, sorting, mating, return transportation, and properly restocking with the right mates.

The DANGER phase of the management of paired garments is the phase in which the present invention finds its major application.

Conventional, one-piece clothes pins of the non-spring type have been in existence since before 1900. Such conventional, one-piece clothes pins were originally designed to hold wet clothing to a clothesline for drying. Made of wood or plastic, these conventional, one-piece clothes pins do not lend themselves to the joining of garments during the washing and drying operation. As a result, a considerable amount of time is expended in re-mating paired garments after laundering, i.e., washing and drying.

Conventional spring-type clothes pins, consisting of two lever members and a coil spring or other resilient member which joins the two lever members and normally biases their active ends together, have been in existence since 1900. Such conventional spring-type clothes pins were originally designed to hold wet clothing to a clothesline for drying. Made of wood or plastic, they are capable of holding both socks of a pair together, but because of their short holding area, the clip angle, and small jaw shape, they tend to stretch the garments which they temporarily join. Because of the washing action of an automatic clothes washer, spring-type clothes pins do not keep paired garments together effectively during washing.

Paired garment laundry bags have been in use for automated washers and dryers for more than thirty years. They only keep paired garments together in a jumble with other garments, but not in pairs. In some cases the small bags which might be used by individuals have the disadvantage of not allowing access to the soap and the cleansing action afforded by a washing machine. As a result, a considerable amount of time is still needed to re-mate the pairs.

Regular plastic/metal hangers without pincher clips require the garment to be folded near the middle to keep the garment balanced on the hanger. This results in a mid-garment crease, and a potential lint/dust line. Regular plastic/metal hangers with pinching clips require a manual sliding adjustment to be used effectively. In addition, most of the clips pinch the fabric very tightly at two points, stretching the fabric. In general, no means is provided for varying the grasping force exerted on the garment by the pincher clips.

Once socks are paired they must be either folded or have one sock stuffed into the other so as to prevent them from becoming separated.

Thus, it will be seen that the need has long existed for a connecting device for joining together paired garments in their proper pairs during the non-wearing phase, which device provides a secured, temporarily attachable connection between the paired garments during laundering without effecting the material of the garments.

By combining the manufacture, transportation, display for sale, and home use functions into a single paired garment device, it becomes more efficient and environmentally economic. By being able to keep paired garments mated at all times when the garments are not being worn, there is less chance for losing one garment of the pair, or not having the device ready where it is needed.

An advantage of the present invention is that it can be used for a wide variety of garments, and materials, and is not limited to fabrics or paired garments. By means of the hook and the eye incorporated therein, a device incorporating the present invention may be used as a clothes pin, or in conjunction with a common hanger it may be used as a tie or scarf hanger. Because of its plastic construction and double hinged design, a device embodying my present invention can easily accommodate most objects of different sizes.

Some of the prior art connecting devices damage the paired garments by penetrating the fabric, while others crumple or bunch the fabric together while securing them. Those that clamp the fabric in a concentrated, specific area do not allow for washing and drying of the area being compressed.

It is believed that the aforementioned patents do not anticipate my invention because they do not combine the manufacturing, transportation, display for sale, and home use of storage and laundering, or require either a clothesline or a box to complete their function.

It is also believed that the failure of the devices shown and described in these prior art patents to find wide public acceptance bears witness to their impracticality.

SUMMARY OF THE INVENTION

My invention addresses the problem of efficiently managing paired garments, such as socks, gloves and leg warmers, and is particularly directed to certain facets of that problem which are believed to be unaddressed by the prior art, and are summarized below at least in part with reference to its objects.

Accordingly, it is an object of my invention to provide paired garment management apparatus which allows paired garments to be temporarily joined together after wearing, and to remain joined together until selected to be worn again.

Another object of my present invention is to provide paired garment management apparatus which does not require the modification or alteration of the paired garments to be joined thereby.

Yet another object of my present invention is to provide paired garment management apparatus which is simple to use, requires very limited prior training or time to learn how to use, and minimizes the time it takes to engage paired garments and to disengage paired garments.

A further object of my present invention is to provide paired garment management apparatus which is adapted to handle garments of many different weights and sizes, whether heavy woolen or lightweight nylon or dacron, and to accommodate garments of many different lengths, such as leg warmers.

A yet further object of my present invention is to provide paired garment management apparatus which can be manufactured entirely of plastic, in a single injection molding step, in several different colors, so that each family member may be designated by a particular color, such that after laundering the paired garments can more quickly be sorted by the color of its associated garment management device into piles for each family member.

An additional object of my present invention is to provide paired garment management apparatus having the capability of securing various garments to a conventional garment hanger or any rod-like element.

Another object of my present invention is to provide a universal garment clamp device to enable paired garments or other small articles of clothing to be secured together for display, storage, transportation and laundering.

Yet another object of my present invention is to provide a connecting device which does not interfere with the usual laundering of paired garments, and is not affected by the various soaps, detergents, bleaches, water conditioners and washer and dryer temperatures in common use, and a material which will not damage or be damaged by the environment in which it operates.

A further object of my present invention is to provide paired garment management apparatus the use of which in accordance with the method of my invention dramatically reduces the time it takes to manually match and sort paired garments after laundering so that they can be returned to their respective wearers for the next wearing cycle.

Another object of my present invention is to bind together similar ones of a pair of clothing articles so that the pair will not become separated, preventing loss of one of a pair and consequently rendering the remaining one of the pair valueless.

A yet further object of my present invention is to reduce the stress and time it takes to manage paired garments.

Another object of my present invention is to allow garments to be stored hanging without stretching the neck, or creasing the fabric in the middle while being stored.

Yet another object of my present invention is to provide paired garment management apparatus which engages the paired garments over an extended contact area and thus does not stretch or tear the fabric of the garments.

A further object of my present invention is to provide paired garment management apparatus which is simple in design and economical to produce in quantity and yet durable, safe and sturdy.

Another object of my present invention is to provide paired garment management apparatus which will not bunch, crumble or inhibit the washing or drying of the paired garments.

A yet further object of my present invention is to provide paired garment management apparatus which will retain paired garments in a neat, vertical, pendant position for storage and display, storing by rolling around the connecting device, or by simply clamping the paired garments together for storage.

A yet further object of my present invention is to provide paired garment management apparatus which serves to display paired garments in such a way that they will not readily slide off or become inadvertently disengaged.

Another object of my present invention is to provide paired garment management apparatus which will not readily break, or lose a garment of a pair, and which when placed with other similar devices can be readily separated from each other for use.

A further object of my present invention is to provide paired garment management apparatus of the above-described kind which include manually mutually interengagable hook means adapted for locking the apparatus in its garment clamping condition, and thus locking a pair of such garments therein.

A yet further object of my present invention is to provide paired garment management apparatus of the above-described kind which include a hook whereby the apparatus and the paired garments joined thereby may be securely hooked to a conventional clothesline, rod, or the like, for open air drying of the socks.

Another object of my present invention is to provide paired garment management apparatus of the above-described kind which include a specially shaped hook adapted to be engaged with a conventional clothes pole, whereby the apparatus and the pair of garments joined thereby can be securely hung on a conventional clothes pole for display and easy accessibility, in the home or in a retail establishment.

Another object of my present invention is to provide methods and apparatus for the management of paired garments, which apparatus may be used in storing and displaying paired garments for easy accessibility and display, and for organizing and storing the same in such manner that a minimum of time is wasted in bringing unlaundered garments to the laundering apparatus, laundering, returning laundered garments to the place of storage, and distinguishing between laundered and unlaundered garments.

My invention achieves the aforesaid objects by providing a clip for fastening fabric together. In fulfillment and implementation of the previously recited objects, a primary feature of my invention resides in the provision of a one-piece injection molded device with two expansion hinges, a hook for hanging, two arms of equal length, and a simple lock. One end of the spring set hinges is closed, while the other end's spring set hinge is open, allowing for garments to be easily inserted, and taken out, when opened. The arms attached to the spring set hinges can be opened to an angle as wide is as needed. When closed, the similar pinching arms lock the garments between them with pressure from the pinching arms.

In using the present invention it is intended that each family member will have a group of fastening devices of a specific color for his/her own garments. When used for socks, as the paired garment, all socks would be stored within the devices. When taken out to be worn, the device would be unlocked, and the pair of socks worn. When the socks are taken off, the socks would be again placed into the device and again locked.

In accordance with my invention, a way to facilitate the paired garment re-mating problem is for the wearer to clamp each pair of soiled garments, e.g., socks, together when he/she removes them. Then the paired garments remain clamped together through the laundering process, and are returned to the wearer still clamped together. The clamp is only removed when the garments are being worn, and put back on the garments when the garments are taken off. After the paired garments are removed they are placed into the device, and the clamp is closed. When the paired garments are selected to be worn again the clamp is opened, and the garments are removed. The opening and closing of the clamp is achieved by applying pressure on the open end of the clamp. The matching members A and B of a pair of socks are laid alongside one another and the device is clamped around the socks approximately midway along the length thereof.

It is readily apparent that the clamp device will continually be recycled. As laundered garments are unclamped to be worn, the clamp will remain open and out. When the garments are removed from wearing, the open unused clamp is used to re-mate the paired garments. Extra, open clamp devices can be easily stored on a hook in the laundry area.

The device of my invention will withstand repeated and prolonged contact with water and detergents without deteriorating. It will also withstand the temperatures used in today's washers and dryers without damage to the device, other garments, or the machines.

Thus, it will be understood that the paired garment management device of my invention is constructed and arranged for carrying out the method of my invention, in accordance with which paired garments are joined together continuously from doffing to donning, and are only separated from donning to doffing, i.e., during wearing.

Other objects of my invention will in part be obvious and will in part appear hereinafter.

My invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of my invention will be indicated in the claims appended hereto.

In accordance with a principal feature of my invention a clamp is provided for clamping together the two garments of a matched pair by clampingly engaging both garments of the pair over an extended contact area and thus avoiding localized damage to either garment of the pair and avoiding distortion of either garment.

In accordance with another principal feature of my invention the clamp of my invention firmly clamps the two garments of a pair together without penetrating the fabric of either garment.

In accordance with yet another principal feature of my invention the clamp of my invention may be quickly and easily locked in clamping engagement with a pair of socks, or the like, and will remain thus locked during the machine washing and machine drying of the socks of that pair, even when a large number of other pairs of socks, each clamped together by a substantially identical clamp, are simultaneously being laundered in the same laundering equipment.

In accordance with a further principal feature of my invention the clamp of my invention is comprised of two elongated linear members, said elongated linear members terminating at one end in said ring-shaped portion, which ring-shaped portion is split in such manner as to leave the ends of said two elongated linear members adjacent thereto unjoined.

In accordance with an additional principal feature of my invention the opposite ends of said two elongated linear members from said ring-shaped member terminate in a pair of semi-circular portions, and the ends of said semi-circular portions remote from said elongated linear members terminate in mutually interengagable hook portions, said hook portions facing inward so as not to allow garments to get caught on said locking means, which hook portions together constitute the locking means by means of which said elongated linear members can be locked together in clamping engagement with a pair of garments disposed between said elongated linear members.

In accordance with another principal feature of my invention, the clamps of my invention are provided with suspension hook means located substantially centrally of one of said elongated linear members, one of the outer side thereof remote from the garment-engaging edge thereof, by the use of which suspension hook means the clamp and a pair of garments clamped therein may readily be hung on a clothesline for open air drying of the garments, or on a dowel or other rod for display at the point of sale.

In accordance with yet another principal feature of my invention certain clamps of my invention may be provided with extended suspension hooks which are adapted to engage a standard clothes pole, whereby the suspension hook grasps the clothes pole requiring direct manual action to remove the clamp from the clothes pole.

In accordance with yet another principal feature of my invention certain clamps of my invention may be provided without a suspension hook means located substantially centrally of one of said elongated linear members.

In accordance with another principal feature of my invention the clamps of my invention are provided in various sizes, some of which sizes are particularly adapted for the clamping of pairs of socks, and other ones of which sizes are adapted for the clamping of one or more larger fabric articles, such as table cloths, pants and skirts.

For a fuller understanding of the nature and objects of my invention, reference should be had to the following detailed description, taken in connection with the accompanying drawings.

DESCRIPTION OF THE PREFERRED EMBODIMENTS

Figure 1:
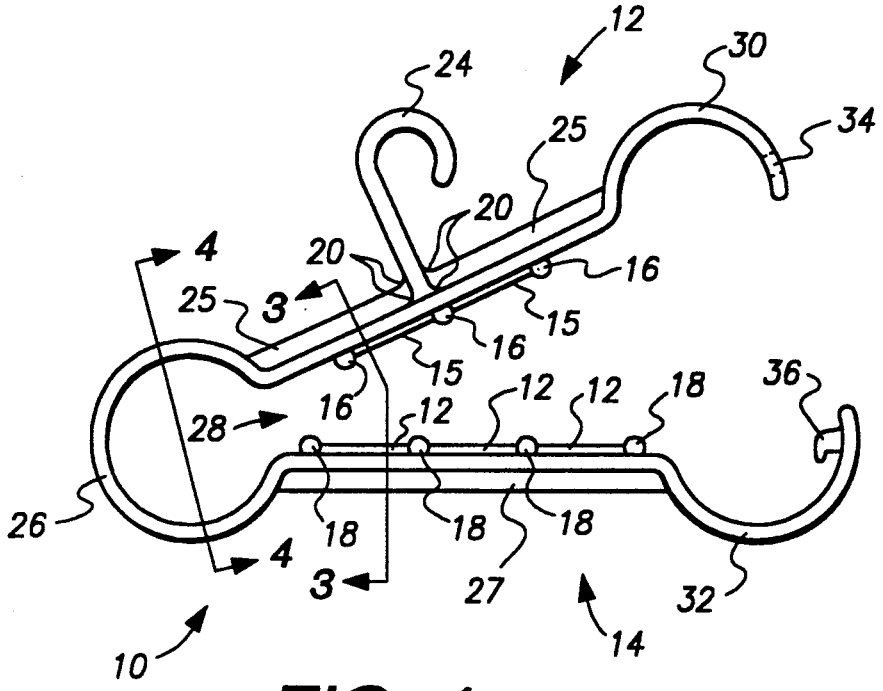
FIG. 1 is an elevational view of a clamp of my invention in its relaxed or unlocked, non-clamping state.

Referring now to FIG. 1, there is shown a one-piece injection molded complete clamp 10 constructed in accordance with the first preferred embodiment of my invention.

In accordance with my invention, clamp 10 will be color coded, can be braille coded, and is fabricated in a single step via a conventional injection molding process, thus requiring no assembly, of a material which permits it to be used continuously from doffing of a pair of garments to the donning of a pair of garments, and the material can withstand repeated cycles of automatic washing and drying.

In accordance with the method of my invention, the doffed paired garments are immediately placed together with both garments lying flat, oriented in the same direction. Clamp 10 is then manipulated to embrace the thus disposed paired garments near the middle thereof, and the elongated parts of claim 10 are locked together, clamping the garments therein. At the appropriate time, the paired garments, thus clamped together, are placed in a conventional washing machine for washing, and then in a conventional drying machine for drying. The garments remain thus clamped together while being washed and while being dried.

Further, in accordance with my invention, the sorting of the garments by individual family member involves using the visual color codes established for each individual. Once the garments of each individual have been thus sorted, and while still joined by specimens of clamp 10, the pairs of garments are returned to the particular individual's clean garment inventory at the proper location for that individual and garment. If any individual prefers to keep his or her paired garments hung, then the hook, or the loop at the end of the clamp 10, should be used.

Suitable material from which clamp 10 can be fabricated include, but are not limited to, the following: polybutadiene rubber, butadiene-styrene rubber, butadiene-acrylonitrile rubber, polyethylene, polypropylene, polycarbonate, ethylene-propylene copolymers, etc. The use of propylene copolymers will contribute longevity to the hinge of clamp 10.

Figure 2:
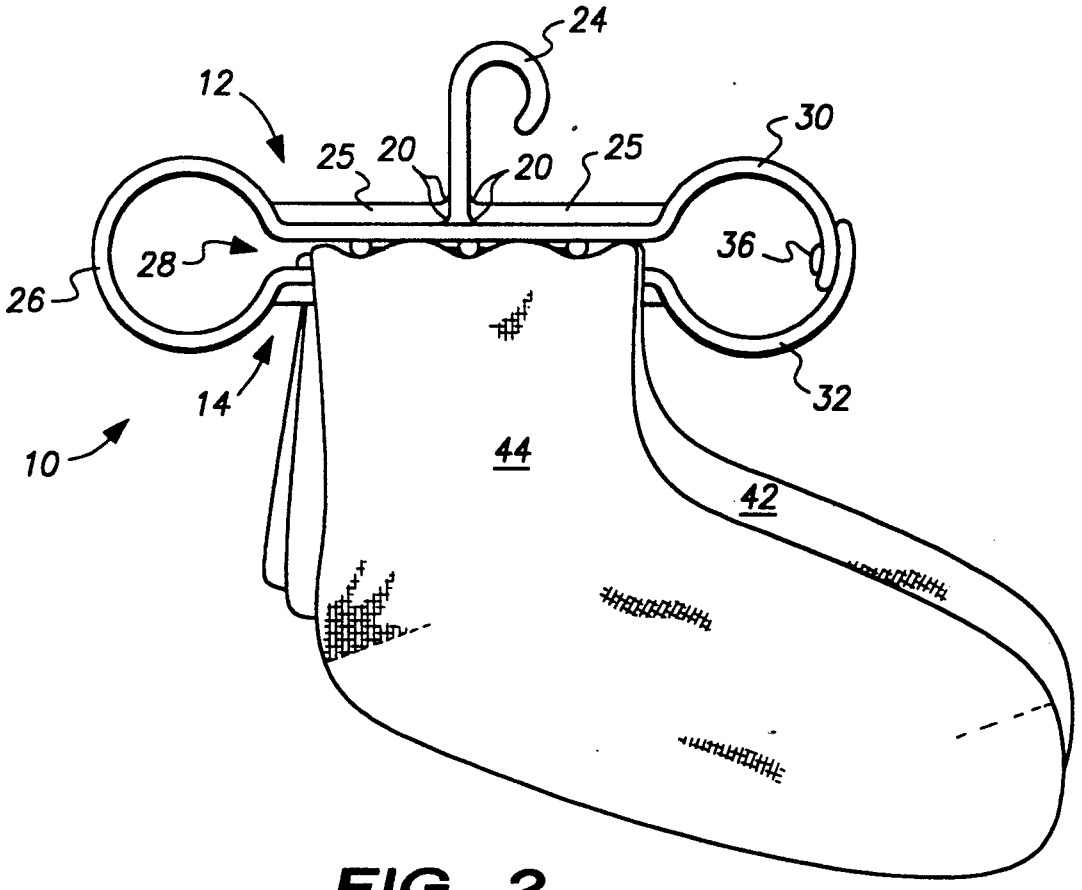
FIG. 2 is an elevational view of the clamp of my invention shown in FIG. 1, in its locked condition, and a partial showing of a pair of socks clamped together thereby.

As may be seen by comparison of FIGS. 1 and 2, clamp 10 is fabricated from a single body of material, preferably one of the materials known as plastics, e.g., polypropylene or polycarbonate.

Referring again to FIG. 1, it will be seen that the central portion of clamp 10 is comprised of two elongated, substantially rectilinear members 12 located on a plane vertically above number 14. It will also be seen that the inner edges of elongated rectilinear members 12, 14 have barrel-shaped ribs 16, 18 running in a perpendicular direction relative to members 12, 14. In addition, structural ribs 15, 17 run in the same direction along the inside of elongated rectilinear members 12, 14 between barrel-shaped ribs 16, 18.

As also seen in FIG. 1, all of the barrel-shaped ribs 16, 18 are substantially identical and of curved contour. The end points of these ribs provide surface area onto which the push pins of the injection mold may apply pressure in order to eject clamp 10 from the mold.

As also seen in FIG. 1, a suspension hook 24 is formed on the outer edge of elongated member 12 in a fixed direction. The end of hook 24 is circular in shape, proceeding beyond the normal 180 degree curve, to wrap around a round object locking itself onto the rounded object. Hook 24 can easily be slid back and forth in the same direction as that of the rounded object, but cannot easily be taken off of the rounded object without applying additional pressure. By having hook 24 proceed beyond the 180 degree curve greatly reduces the opportunity for garments and hooks from catching on the end of hook 24. The base of hook 24 is joined to elongated member 12 using fillets 20.

As further seen in FIG. 1, adjacent ends of elongated members 12, 14 terminate in a generally ring-shaped member 26 as an integral hinge. Ring-shaped member 26 does not take the form of a complete ring, but rather is provided with a gap 28. One end of elongated member 12 is integrally joined with ring-shaped portion 26 on one side of gap 28, and the adjacent end of elongated member 14 is integrally joined with ring-shaped member 26 on the other side of gap 28.

As further seen in FIG. 1, the end of elongated member 12 opposite ring-shaped portion 26 is integrally joined to a semicircular portion 30, and the end of elongated member 14 opposite ring-shaped portion 26 is integrally joined with a semi-circular portion 32 also forming an integral hinge when locked.

As yet further seen in FIG. 1, a locking cavity portion 34 is integrally joined with semi-circular portion 30 at the end of semi-circular portion 30 remote from elongated member 12. Further, a second locking hook portion 36 is integrally joined with semicircular portion 32 at the end of semi-circular portion 32 remote from elongated member 14.

It is to be understood that clamp 10 is shown in FIG. 1 in its relaxed or unlocked position, i.e., in the configuration which is assumes when initially divulsed from the cavity in which it is molded.

Referring now to FIG. 2, clamp 10 is shown in its locked condition with a pair of socks 42, 44 clamped therebetween. In this locked condition, locking hook portions 34, 36 are mutually interengaged, having been manipulated into this mutually interengaged state by the user, in order to bring elongated member 12 into close proximity with elongated member 14, and thus to clamp socks 42, 44 firmly therebetween.

Figure 3:
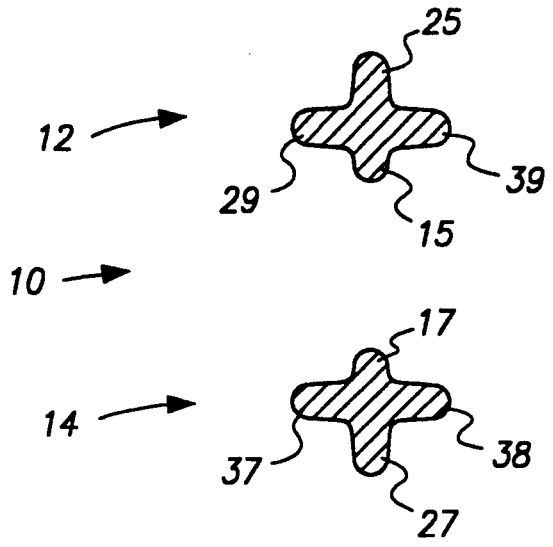
FIG. 3 is a cross-sectional view of the clamp of my invention shown in FIG. 1, taken on plane 3—3 of FIG. 1.

As seen in FIG. 3, elongated members 12, 14, have vertical ribs and horizontal ribs for structural support. Elongated member 12, has an outside rib 25, an inside rib 15, a left side rib 29 and a right side rib 39. Likewise, elongated member 14, has an outside rib 27, an inside rib 17, a left side rib 37, and a right side rib 38. The horizontal ribs 29, 39 of elongated member 12, and the horizontal ribs 37, 38 of elongated member 14, are thinner at the outer ends, and thicker at the intersection with the vertical ribs. This facilitates clamp 10 to be ejected from the injection mold easily. Clamp 10 has very limited flexibility along rectilinear elongated members 12, 14 because of the double ribs, as can be seen in FIG. 3.

Figure 4:
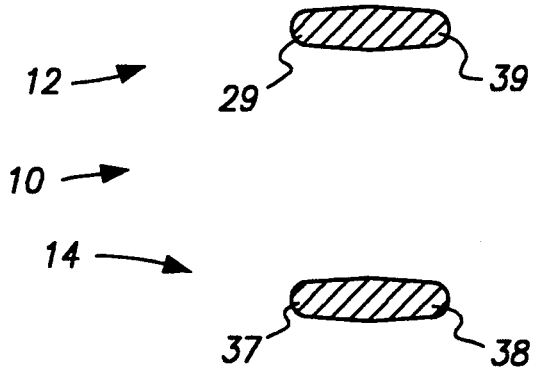
FIG. 4 is a cross-sectional view of the clamp of my invention shown in FIG. 1, taken on plane 5—5 of FIG. 1.

As seen in FIG. 4, elongated members 12, 14, have only horizontal ribs. Elongated member 12 has a left side rib 29 and a right side rib 39. Likewise elongated member 14 has a left side rib 37 and a right side rib 38. The horizontal ribs 29, 39 of elongated member 12, and the horizontal ribs 37, 38 of elongated member 14, are thinner at the outer ends and thicker at their midpoint. This facilitates ejecting clamp 10 from the injection mold. Clamp 10 has substantial spring like flexibility to open and close along members 29-39 and 37-38 since the ribs are in a single plane.

Figure 5:
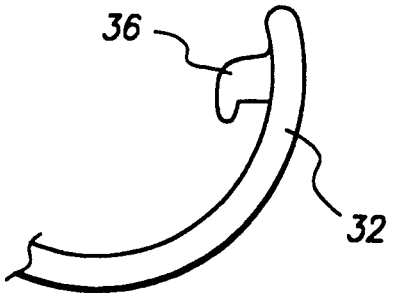
FIG. 5 is a side view of the lower portion of the lock of the clamp of my invention as shown in FIG. 1.

As seen in FIG. 5, the inside, downward facing male half of locking means 36 is integrally joined with semi-circular portion 32 near the end of semi-circular portion 32 remote from elongated member 14. This location and direction greatly reduces the opportunity for the locking means 36 from catching on garments while open.

Figure 6:
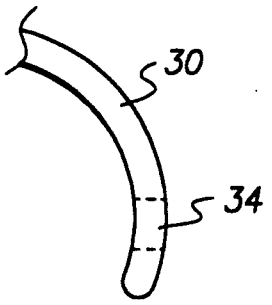
FIG. 6 is a side view of the upper portion of the lock of the clamp of my invention as shown in FIG. 1.

As seen in FIG. 6, the female cavity portion of locking means 34 is integrally joined with semi-circular portion 30 near the end of semi-circular portion 30 remote from elongated member 12.

Figure 7:
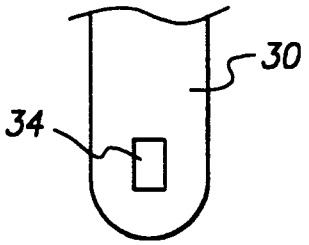
FIG. 7 is an end view of the upper portion of the lock of the clamp of my invention as shown in FIG. 6.

FIG. 7, is an end view of the female cavity portion of lock means 34.

Figure 8:
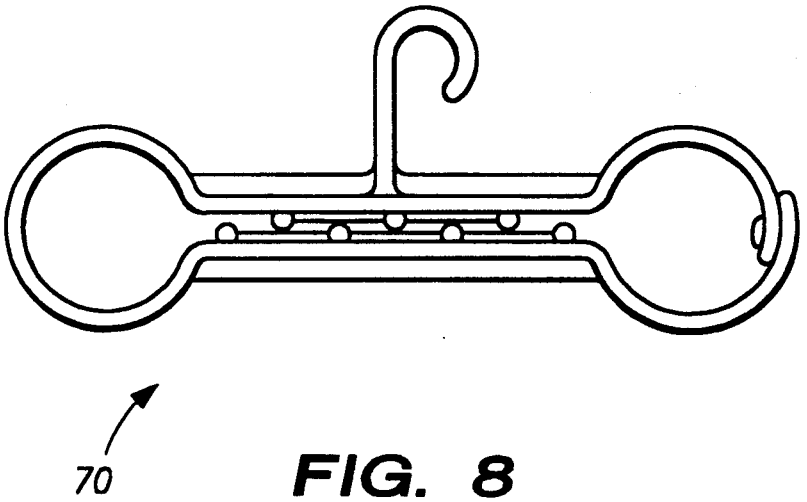
FIG. 8 is an elevational view of the clamp of the second preferred embodiment of my invention in its locked condition, as it would be used to hold a shirt or sweater.

Referring now to FIG. 8, there is shown a clamp 70 of the second preferred embodiment of my invention. Comparing FIG. 8 with FIG. 1, it will be seen that clamp 70 of the second preferred embodiment differs from clamp 10 in that clamp 70 is substantially larger than clamp 10 of the first preferred embodiment.

Figure 9:
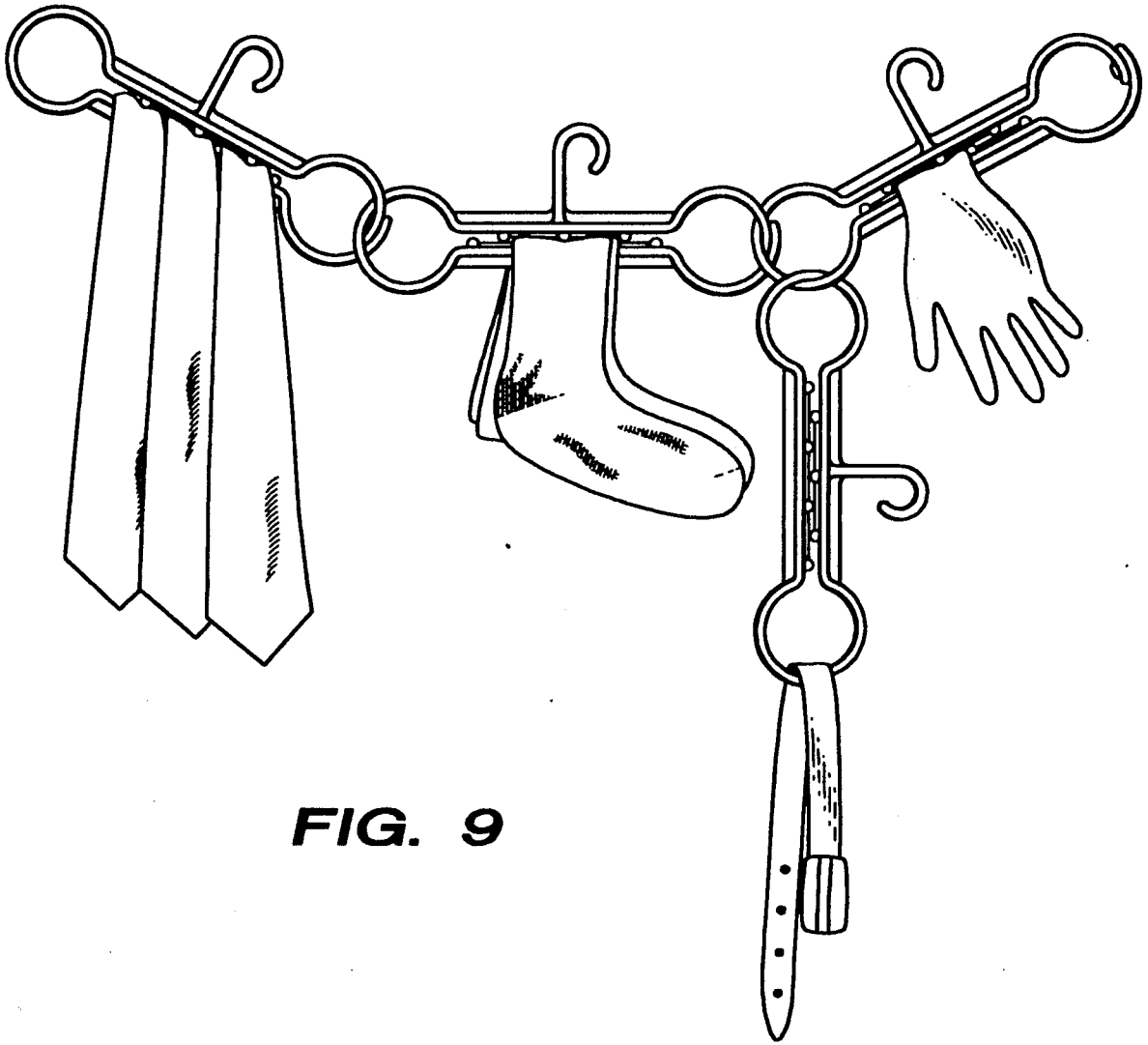
FIG. 9 is an elevational view of clamps of my invention, chained together, supporting each other, at the same time able to support objects within the grasp of each clamp.

Referring now to FIG. 9, there is shown a plurality of clamps 10 of the first preferred embodiment joined together, while holding garments. In this manner the clamps 10 may be used as a chain for stretching a distance, while also being used as clamps for holding garments. With the closed ring-shaped portion 26, and locking ring-shaped portion 30-32 it will be evident to those having ordinary skill in the art, informed by the present disclosure, that any combination, length of chains, and that any number of sub group clamps may be grouped together, and is limited only by the need. Individual clamps may be added, or removed from the plurality of clamps as they are not permanently attached.

Figure 10:
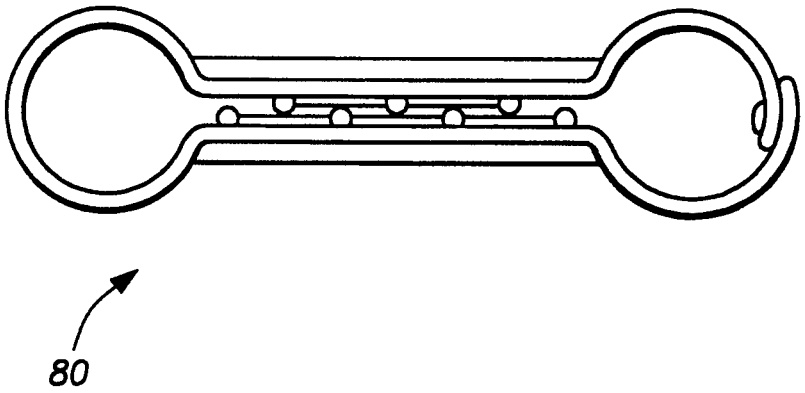
FIG. 10 is an elevational view of the clamp of the third preferred embodiment of my invention in its locked condition.

Referring now to FIG. 10, there is shown a clamp 80 of the third preferred embodiment of my invention. Comparing FIG. 10 with FIG. 1, it is seen that clamp 80 of the third preferred embodiment differs from clamp 10 in that clamp 80 has no hook 24 as shown in the first preferred embodiment.

Thus, in accordance with my invention, it is possible to store a plurality of paired garments, such as socks, by hanging predetermined pluralities thereof, or less, on a standard clothes pole, from which they may easy be removed for inspection or laundering, etc.

It will thus be seen that the objects set forth above, among those made apparent from the preceding description, are efficiently attained, and since certain changes may be made in the above constructions and the methods carried out thereby without departing from the scope of my invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as matter of language, might be said to fall therebetween.

What is claimed is:

1. A one-piece injection-molded device for the management of paired garments, comprising:

a first elongated member having a length and a width;

a second elongated member having the same length and width as the first elongated member;

a first resilient member continguously interconnecting one end of said first elongated member and one end of said second elongated member such that said first and second elongated members generally oppose each other, said first resilient member exerting outward tension on said first and second elongated members such that they separate to form an angle between the member when the device is in an opened state;

locking means for interlocking the other end of said first elongated member and the other end of said second elongated member; and hook means extending in the direction of separation of said first elongated member and outward from said first elongated member intermediate the ends thereof.

2. A one-piece injection-molded device for the management of paired garments, comprising:

a first elongated member having a length and a width and including a first rib extending longitudinally along the outside of the first elongated member, a second rib extending longitudinally along the inside of the first elongated member, and a plurality of third ribs spaced apart on the inside of the first elongated member, said third ribs being perpendicular to the second rib;

a second elongated member having the length and width of the first elongated member and including a fourth rib extending longitudinally along the outside of the second elongated member, a fifth rib extending longitudinally along the inside of the second elongated member; and a plurality of sixth ribs spaced apart on the inside of the second elongated member, said sixth ribs being perpendicular to the second rib and interjacent of the third ribs;

a first resilient member contiguously interconnecting one end of said first elongated member and one end of said second elongated member such that said first and second elongated members generally oppose each other, said first resilient member exerting outward tension on said first and second elongated members such that an angle is formed between the members when the device is in an opened state; and locking means for interlocking the other end of said first elongated member and the other end of said second elongated member when the device is in a locked state.

3. A device for the management of paired garments as claimed in claim 2, further comprising:

a second resilient member interconnecting the other end of said first elongated means member and said locking means; and a third resilient member interconnecting the other end of said second elongated means member and said locking means.

4. A device for the management of paired garments as claimed in claim 3, wherein said locking means comprises an opening in said second resilient member and a catch on said third resilient member, said catch including a tab portion that extends away from said second resilient member such that when the tab portion engages the opening in the locked position, the outward tension on the first and second elongated members causes the opening and tab portion to pull against each other.

5. A device for the management of paired garments as claimed in claim 1, further comprising a first reinforcing member disposed on the first elongated member and a second reinforcing member disposed on the second elongated member.

6. A device for the management of paired garments as claimed in claim 1, further comprising a gripping element disposed on either the first or the second elongated member.

7. A device for the management of paired garments as claimed in claim 2, further comprising a hook extending outward from said first elongated member intermediate the ends thereof, said hook forming a curved portion slightly in excess of 180 degrees which enables the device to grasp a rod.

8. A one-piece injection-molded device for the management of paired garments, comprising:

a first elongated member being generally flat and having an inside surface and an outside surface;

a second elongated member being generally flat and having an inside surface and an outside surface;

a first resilient arcuate member contiguously connecting one end of the first elongated member to one end of the second elongated member such that the inside surfaces of the first and second elongated members generally oppose each other with a separating tension being exerted thereon;

a second resilient arcuate member contiguously connected to the other end of the first elongated member;

a third resilient arcuate member contiguously connected to the other end of the second elongated member;

a first longitudinal rib extending along the outside surface of the first elongated member between the first resilient arcuate member and the second resilient arcuate member;

a plurality of second lateral ribs spaced apart on the inside surface of the first elongated member;

a plurality of third longitudinal ribs extending along the inside surface of the first elongated member perpendicular to and between each of the second ribs;

a fourth longitudinal rib extending along the outside surface of the second elongated member between the first resilient arcuate member and the third resilient arcuate member;

a plurality of fifth lateral ribs spaced apart on the inside surface of the second elongated member and positioned interjacent the second ribs;

a plurality of sixth longitudinal ribs extending along the inside surface of the second elongated member perpendicular to and between each of the fifth ribs;

an opening in the second resilient arcuate member distal from the first elongated member;

an arm extending interiorly from the third resilient arcuate member distal from the second elongated member;

wherein a closed position is defined when the arm is engaged with the opening and wherein an open position is defined when the arm is released from the opening.

* * * * *